US010907506B2

(12) United States Patent
Reiff et al.

(10) Patent No.: US 10,907,506 B2
(45) Date of Patent: Feb. 2, 2021

(54) STATOR BLADES IN TURBINE ENGINES AND METHODS RELATED THERETO

(71) Applicant: General Electric Company, Schenectady, NY (US)

(72) Inventors: Michael Reiff, Waldshut-Tiengen (DE); Dorian Goericke, Fahrweid (CH)

(73) Assignee: General Electric Company, Schenectady, NY (US)

( * ) Notice: Subject to any disclaimer, the term of this patent is extended or adjusted under 35 U.S.C. 154(b) by 90 days.

(21) Appl. No.: 16/116,136

(22) Filed: Aug. 29, 2018

(65) Prior Publication Data

US 2020/0072083 A1 Mar. 5, 2020

(51) Int. Cl.
*F01D 25/24* (2006.01)
*F01D 9/04* (2006.01)

(52) U.S. Cl.
CPC ..... *F01D 25/246* (2013.01); *F01D 9/042* (2013.01); *F05D 2220/30* (2013.01); *F05D 2230/10* (2013.01); *F05D 2230/80* (2013.01); *F05D 2240/12* (2013.01); *F05D 2250/294* (2013.01)

(58) Field of Classification Search
CPC .... F01D 25/246; F01D 9/042; F05D 2230/30; F05D 2230/10; F05D 2230/80; F05D 2240/12; F05D 2250/294
See application file for complete search history.

(56) References Cited

U.S. PATENT DOCUMENTS

| | | | | |
|---|---|---|---|---|
| 6,773,228 | B2 | 8/2004 | Rainous et al. | |
| 9,103,219 | B2 | 8/2015 | Beaujard et al. | |
| 2010/0028146 | A1* | 2/2010 | Martin | F02C 6/08 415/209.3 |

* cited by examiner

*Primary Examiner* — David P Bryant
*Assistant Examiner* — Nirvana Deonauth
(74) *Attorney, Agent, or Firm* — Charlotte C. Wilson; James W. Pemrick

(57) ABSTRACT

A method of modifying a casing of a turbine engine for attaching stator blades within a row of stator blades to the casing, the method including the steps of: forming a circumferentially extending groove in an inboard face of the casing; providing a segmented ring insert that includes bore holes spaced in accordance with a bore hole pattern that corresponds to the row of stator blades; inserting the segmented ring insert into the groove; and securing the segmented ring insert to the casing.

19 Claims, 6 Drawing Sheets

STATOR BLADES IN TURBINE ENGINES AND METHODS RELATED THERETO

BACKGROUND OF THE INVENTION

The subject matter disclosed herein relates to blades within turbine engines, and more specifically, to attachment assemblies for nozzles or stator blades within turbine engines.

As part of maintaining gas or steam turbine engines (collectively, "turbine engines"), it is often necessary to replace a row of nozzles or stator blades (hereinafter "stator blades"), for example, within the turbine section of a gas or steam turbine engine and/or compressor section in a gas turbine engine. It also may be beneficial to change stator blade count (i.e., the number of stator blades circumferentially spaced about the annular flowpath of the engine), as the modified count may improve some aspect of performance. However, changing stator blade count within the row generally modifies the positioning of connectors or interfaces used to secure the stator blades to the surrounding structural casing. For example, the count of stator blades may affect the location and number of bore holes needed in the surrounding casing for the locking pins that are used to circumferentially secure each stator blade. In most cases, changing stator blade count results in new bore locations being interfered with by one or more of the existing bores, for example, via a partial overlap between a new and existing bore hole location.

To correct this issue, significant rework is required, which leads to issues in machining, damages to the existing structure, and results in more machine down time to complete the installation. Accordingly, there remains a need for further advances in this area of technology.

BRIEF DESCRIPTION OF THE INVENTION

The present application thus describes a method of modifying a casing of a turbine engine for attaching stator blades within a row of stator blades to the casing. The method may include the steps of: forming a circumferentially extending groove in an inboard face of the casing; providing a segmented ring insert that includes bore holes spaced in accordance with a bore hole pattern that corresponds to the row of stator blades; inserting the segmented ring insert into the groove; and securing the segmented ring insert to the casing.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
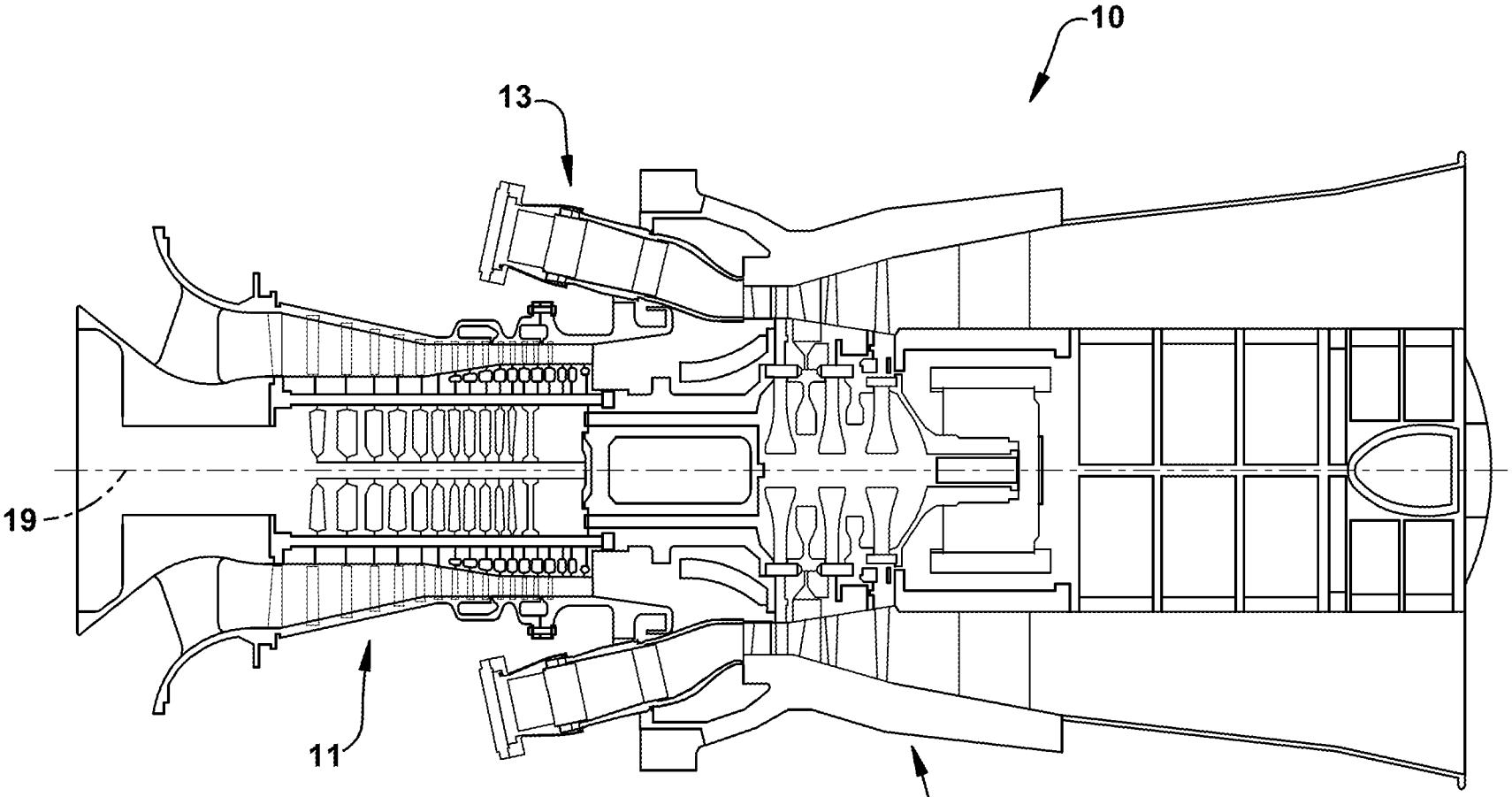
FIG. 1 is a schematic sectional representation of an exemplary gas turbine in accordance with aspects of the present invention or within which the present invention may be used.

Aspects and advantages of the present application are set forth below in the following description, or may be obvious from the description, or may be learned through practice of the invention. Reference will now be made in detail to present embodiments of the invention, one or more examples of which are illustrated in the accompanying drawings. The detailed description uses numerical designations to refer to features in the drawings. Like or similar designations in the drawings and description may be used to refer to like or similar parts of embodiments of the invention. As will be appreciated, each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. It is intended that the present invention covers such modifications and variations as come within the scope of the appended claims and their equivalents. It is to be understood that the ranges and limits mentioned herein include all sub-ranges located within the prescribed limits, inclusive of the limits themselves unless otherwise stated. Additionally, certain terms have been selected to describe the present invention and its component subsystems and parts. To the extent possible, these terms have been chosen based on terminology common to the technology field. Still, it will be appreciated that such terms often are subject to differing interpretations. For example, what may be referred to herein as a single component, may be referenced elsewhere as consisting of multiple components, or, what may be referenced herein as including multiple components, may be referred to elsewhere as being a single component. Thus, in understanding the scope of the present invention, attention should not only be paid to the particular terminology used, but also to the accompanying description and context, as well as the structure, configuration, function, and/or usage of the component being referenced and described, including the manner in which the term relates to the several figures, as well as, of course, the usage of the terminology in the appended claims.

The following examples are presented in relation to particular types of turbine engines. However, it should be understood that the technology of the present application may be applicable to other categories of turbine engines, without limitation, as would be appreciated by a person of ordinary skill in the relevant technological arts. Accordingly, unless otherwise stated, the usage herein of the term "turbine engine" is intended broadly and without limiting the usage of the claimed invention with different types of turbine engines, including various types of combustion or gas turbine engines as well as steam turbine engines.

Given the nature of how turbine engines operate, several terms may prove particularly useful in describing certain aspects of their function. For example, the terms "downstream" and "upstream" are used herein to indicate position within a specified conduit or flowpath relative to the direction of flow or "flow direction" of a fluid moving through it. Thus, the term "downstream" refers to the direction in which a fluid is flowing through the specified conduit, while "upstream" refers to the direction opposite that. These terms should be construed as referring to the flow direction through the conduit given normal or anticipated operation. Given the configuration of turbine engines, particularly the arrangement of the components about a common or central shaft or axis, terms describing position relative to an axis may be used regularly. In this regard, it will be appreciated that the term "radial" refers to movement or position perpendicular to an axis. Related to this, it may be required to describe relative distance from the central axis. In such cases, for example, if a first component resides closer to the central axis than a second component, the first component will be described as being either "radially inward" or "inboard" of the second component. If, on the other hand, the first component resides further from the central axis than the second, the first component will be described as being either "radially outward" or "outboard" of the second component. As used herein, the term "axial" refers to movement or position parallel to an axis, while the term "circumferential" refers to movement or position around an axis. Unless otherwise stated or made plainly apparent by context, these terms should be construed as relating to the central axis of the turbine as defined by the shaft extending therethrough, even when these terms are describing or claiming attributes of non-integral components—such as rotor or stator blades—that function therein. Finally, the term "rotor blade" is a reference to the blades that rotate about the central axis of the turbine engine during operation, while the term "stator blade" is a reference to the blades that remain stationary.

Figure 2:
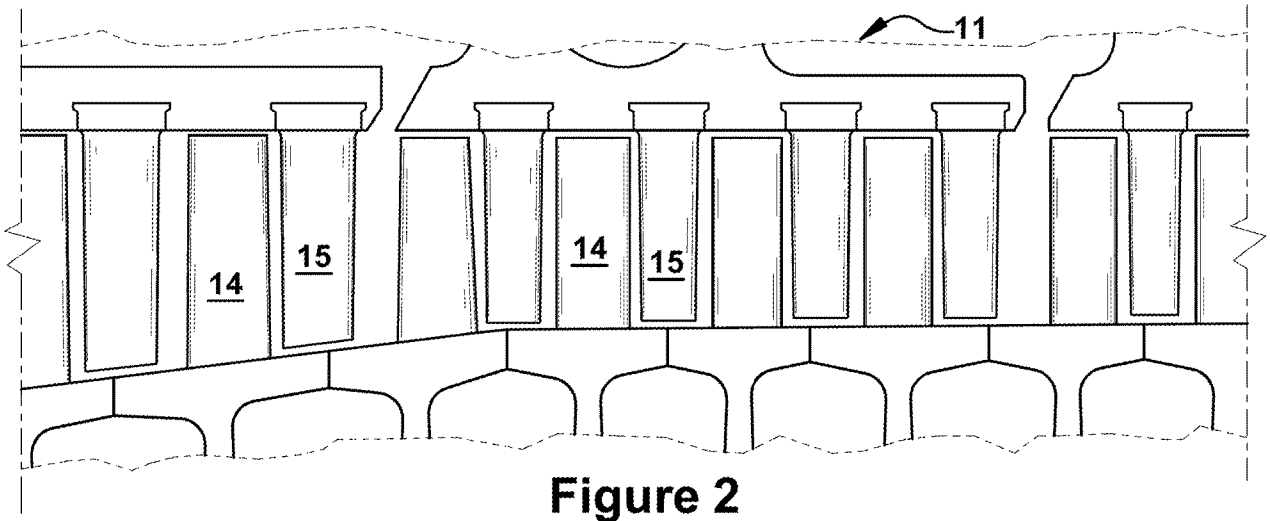
FIG. 2 is a section view of the compressor section of the gas turbine of FIG. 1.
Figure 3:
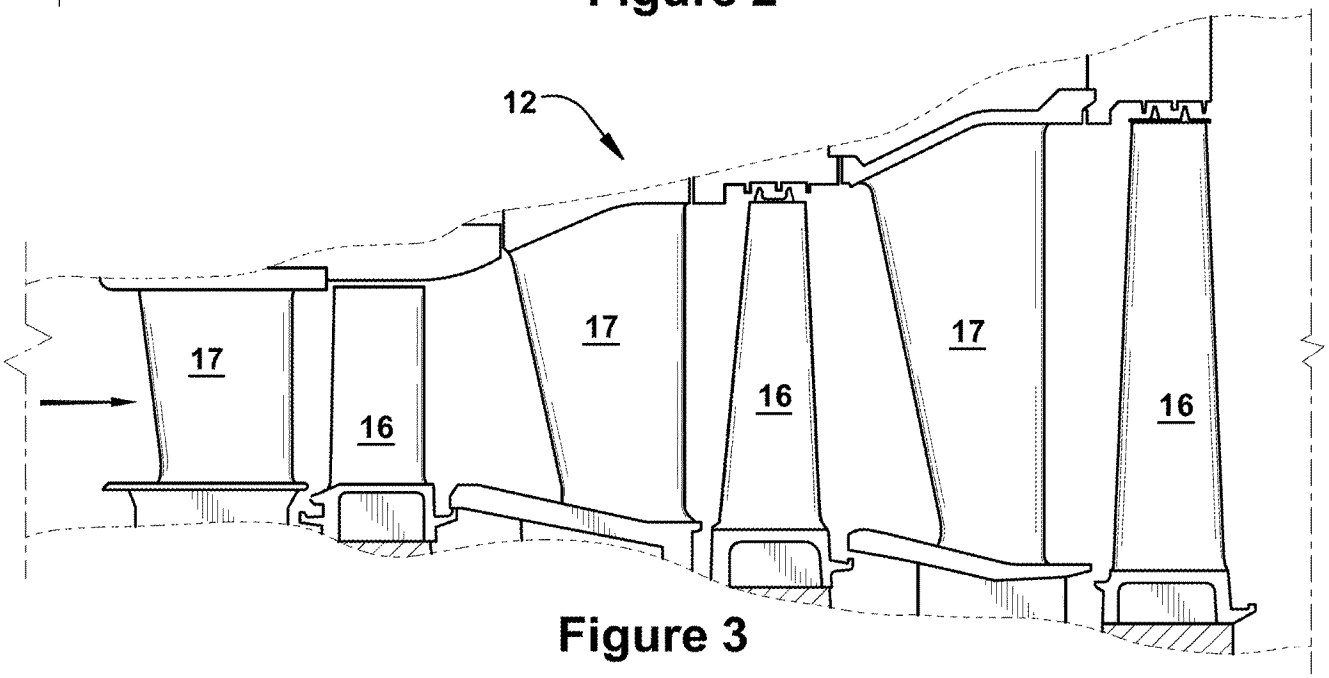
FIG. 3 is a section view of the turbine section of the gas turbine of FIG. 1.

By way of background, referring now with specificity to the figures, FIGS. 1 through 3 illustrate an exemplary gas turbine in accordance with the present invention or within which the present invention may be used. It will be understood by those skilled in the art that the present invention may not be limited to this type of usage. As stated, the present invention may be used in gas turbines, such as the engines used in power generation and airplanes, steam turbine engines, as well as other types of rotary engines as would be recognized by one of ordinary skill in the art. The examples provided, thus, are not meant to be limiting unless otherwise stated. FIG. 1 is a schematic representation of a gas turbine 10. In general, gas turbines operate by extracting energy from a pressurized flow of hot gas produced by the combustion of a fuel in a stream of compressed air. As illustrated in FIG. 1, gas turbine 10 may be configured with an axial compressor 11 that is mechanically coupled by a common shaft or rotor to a downstream turbine section or turbine 12, and a combustor 13 positioned between the compressor 11 and the turbine 12. As illustrated in FIG. 1, the gas turbine may be formed about a common central axis 19.

FIG. 2 illustrates a view of an exemplary multi-staged axial compressor 11 that may be used in the gas turbine of FIG. 1. As shown, the compressor 11 may have a plurality of stages, each of which include a row of compressor rotor blades 14 and a row of compressor stator blades 15. Thus, a first stage may include a row of compressor rotor blades 14, which rotate about a central shaft, followed by a row of compressor stator blades 15, which remain stationary during operation. FIG. 3 illustrates a partial view of an exemplary turbine section or turbine 12 that may be used in the gas turbine of FIG. 1. The turbine 12 also may include a plurality of stages. Three exemplary stages are illustrated, but more or less may be present. Each stage may include a plurality of turbine nozzles or stator blades 17, which remain stationary during operation, followed by a plurality of turbine buckets or rotor blades 16, which rotate about the shaft during operation. The turbine stator blades 17 generally are circumferentially spaced one from the other and fixed about the axis of rotation to an outer casing. The turbine rotor blades 16 may be mounted on a turbine wheel or rotor disc (not shown) for rotation about a central axis. It will be appreciated that the turbine stator blades 17 and turbine rotor blades 16 lie in the hot gas path or working fluid flowpath through the turbine 12. The direction of flow of the combustion gases or working fluid within the working fluid flowpath is indicated by the arrow.

In one example of operation for the gas turbine 10, the rotation of compressor rotor blades 14 within the axial compressor 11 may compress a flow of air. In the combustor 13, energy may be released when the compressed air is mixed with a fuel and ignited. The resulting flow of hot gases or working fluid from the combustor 13 is then directed over the turbine rotor blades 16, which induces the rotation of the turbine rotor blades 16 about the shaft. In this way, the energy of the flow of working fluid is transformed into the mechanical energy of the rotating blades and, given the connection between the rotor blades and the shaft, the rotating shaft. The mechanical energy of the shaft may then be used to drive the rotation of the compressor rotor blades 14, such that the necessary supply of compressed air is produced, and, for example, a generator to produce electricity.

Figure 4:
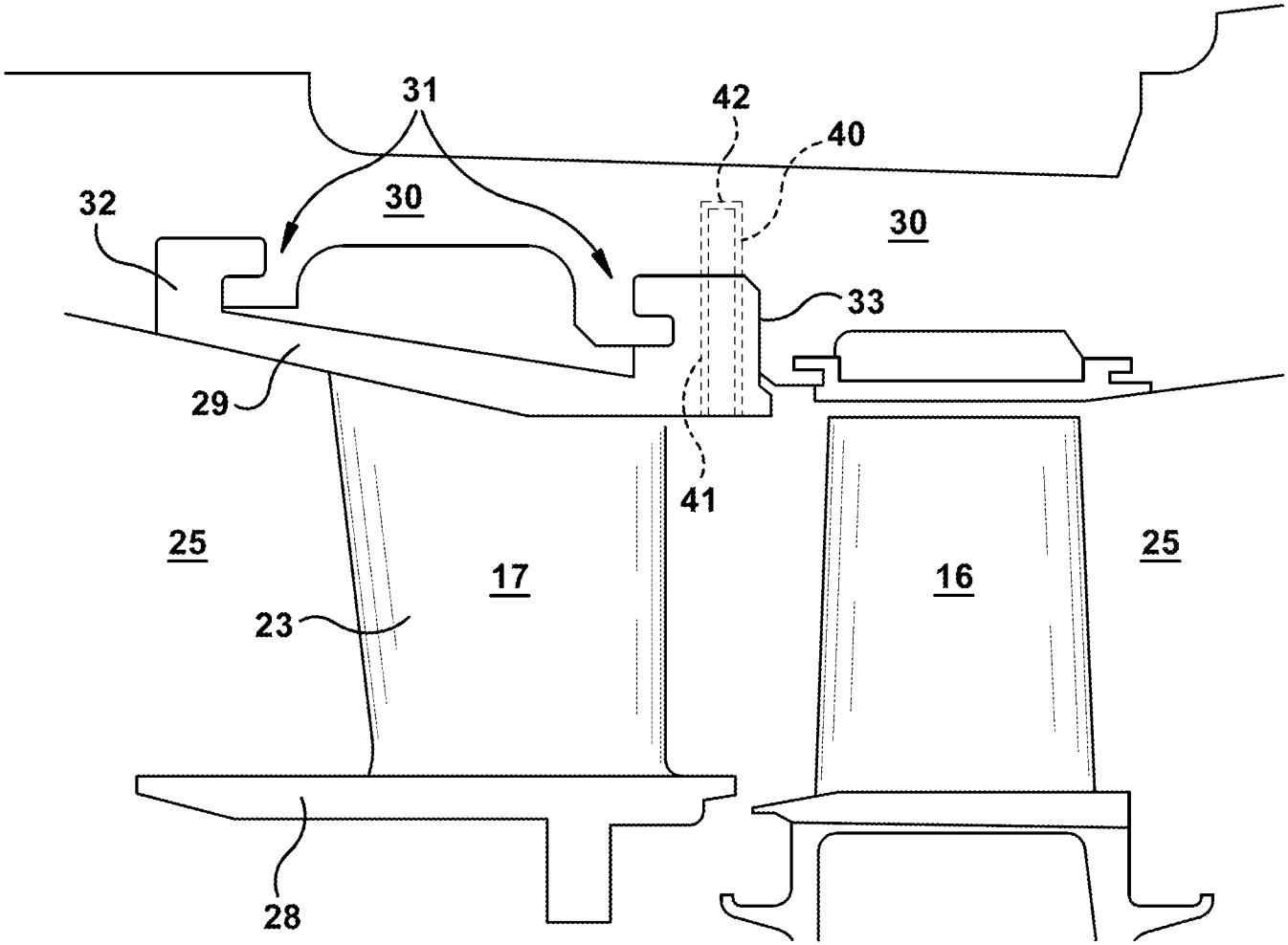
FIG. 4 is a section view of a working fluid flowpath having a stator blade connected to the casing via a locking pin.

FIG. 4 is an enhanced section view of an annular shaped working fluid flowpath 25 of a turbine engine, which includes a rotor blade 16 and stator blade 17. As shown, the stator blade 17 includes an airfoil 23 that extends radially between inner and outer platforms 28, 29, which are formed to the inner and outer sides of the airfoil 23, respectively. The inner and outer platforms 28, 29 may be integrally formed with the airfoil 23 of the stator blade 17. As will be appreciated, the inner and outer platforms 28, 29 define inner radial and outer radial boundaries, respectively, of the working fluid flowpath 25.

As further illustrated in FIG. 4, the outer platform 29 of the stator blade 17 may be generally supported by a structure, which may be referred to as an inner carrier or casing 30, that encloses the surrounds and substantially encloses the working fluid flowpath 25. For example, as shown, the outer platform 29 may connect to casing 30 via circumferentially engaged connector 31 in which mating surfaces formed on the leading edge 32 and trailing edge 33 of the outer platform 29 interlock with corresponding mating surfaces formed in the casing 30. During installation, the stator blades 17 may be slidably engaged with the casing 30, with each stator blade 17 being circumferentially inserted into the casing 30 once the appropriate alignment of the mating surfaces within the connector 31 is achieved. To complete installation, the stator blade 17 may then be secured in a particular circumferential position via the use of a locking pin 40. Specifically, a platform hole 41 formed within the outer platform 29 is brought into alignment with a corresponding bore hole 42 formed into the casing 30 once the stator blade 17 has achieved its desired circumferential position. Then, to complete the installation of the stator blade 17, the locking pin 40 is inserted into the platform hole 41 and corresponding bore hole 42 so that the locking pin 40 resides in each and, thus, extends across the interface between the stator blade 17 and casing 30. In this way, the locking pin 40 locks the circumferential position of the stator blade 17 within the casing 30 and, thus, prevents circumferential displacement of the stator blade 17 during operation.

Figure 5:
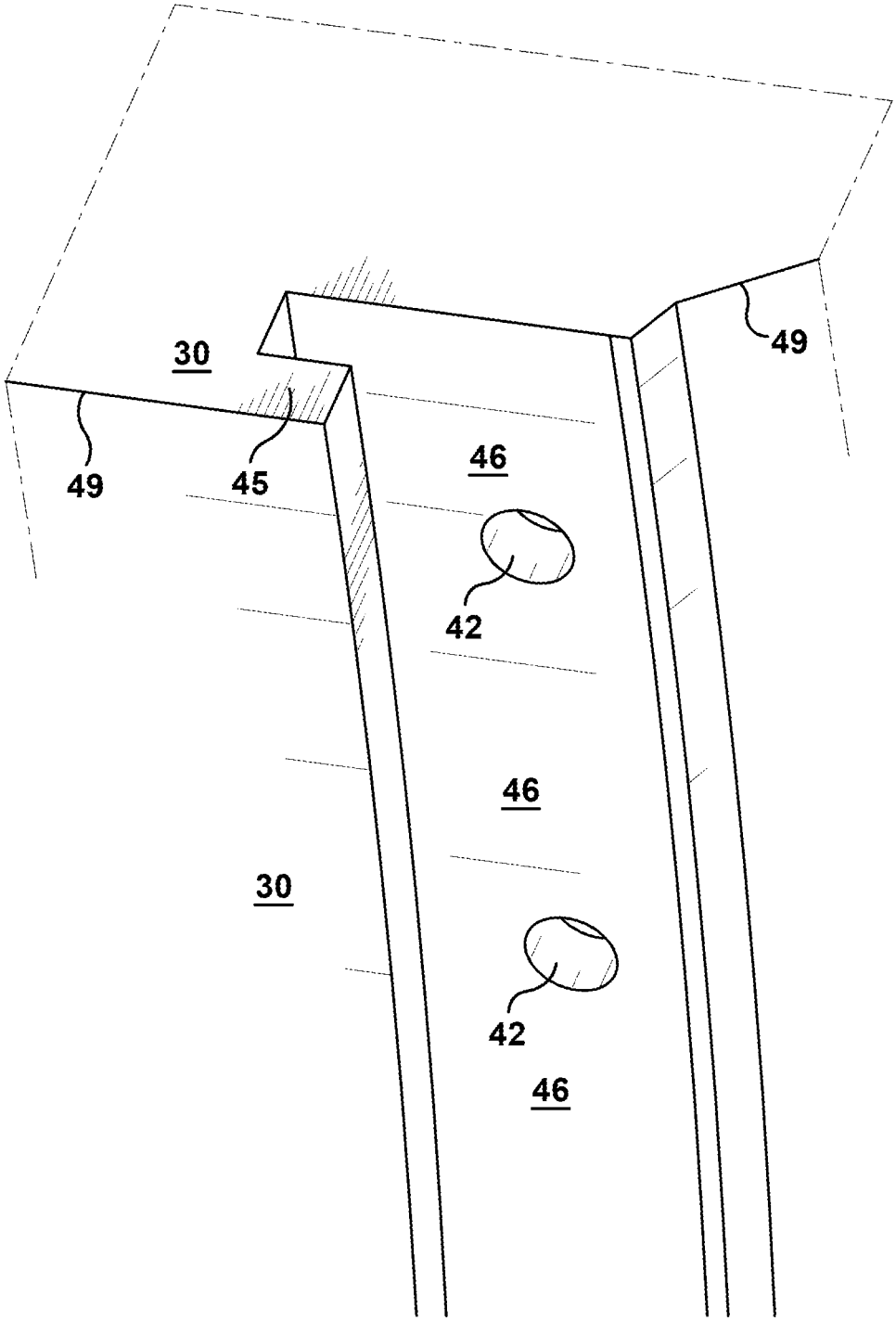
FIG. 5 is a perspective view of a casing having bore holes for receiving a locking pin for circumferentially securing a stator blade.

FIG. 5 is a perspective view of a casing 30 having exemplary bore holes 42 for receiving a locking pin 40 during the installation of stator blades 17. As will be appreciated, the casing 30 is shown at a split-line 49, which is where the casing 30 is sectioned (typically in half) for facilitating assembly of the turbine engine. As discussed above, the casing 30 may include one or more mating surfaces 45 with which corresponding mating surfaces on the outer platform 29 of a stator blade 17 may be circumferentially engaged to form the connector 31. Once such mating surfaces are properly engaged, it will be appreciated that the stator blade 17 is axially and radially secured within the casing 30, i.e., that relative axial and radial movement between the casing 30 and the stator blades 17 is prevented. To circumferentially secure the stator blade 17 within the casing 30, the above-described locking pin 40 may be used in conjunction with the bore holes 42 within the casing 30. Once engage, the locking pins 40 may prevent relative circumferential movement between the casing 30 and the stator blades 17. As used herein, the casing 30 includes an inward facing surface (or "inboard face") 46 into which the bore holes 42 are formed. The inboard face 46 extends circumferentially about the central axis 19 of the turbine engine. According to the pattern that corresponds to a particular stator blade count, the bore holes 42 are typically located at regular circumferential intervals on the inboard face 46. Each bore hole 42 may extend into the casing 30 in the outboard direction from an opening formed on the inboard face 46.

Turbine engine maintenance may periodically include the replacement of stator blades, for example, replacing a row of stator blades within the turbine section of a gas or steam turbine engine or the compressor section in a gas turbine engine. As part of replacing such blade rows, it is occasionally desirable to change stator blade count within the row (i.e., the number of stator blades circumferentially spaced in the row), as the modified count may improve some aspect of performance. However, changing stator blade count generally modifies the positioning of connectors or interfaces used to secure the stator blades to the surrounding carrier or casing. For example, stator blade count affects the location and number of bore holes needed in the surrounding casing for circumferentially securing each stator blade with locking pins. In most cases, a change to stator blade count results in the location of new bore holes being interfered with by one or more of the locations of existing bore holes, for example, via a partial overlap between a new location and an existing one. To correct this issue, significant rework is generally required, which leads to issues in machining, damage to the existing structure, and longer down time for the engine to complete the installation. A conventional solution is to adapt the existing locking features to accommodate the new ones by fitting bushings and/or closing or patching existing bore holes by welding. After closing the existing ones, new bore holes are then machined or drilled into the casing to fit the new bore hole pattern. As will be appreciated, to complete this type of work generally requires a major outage for the engine, as specially trained personnel and specialized tools must be brought to the site.

Figure 6:
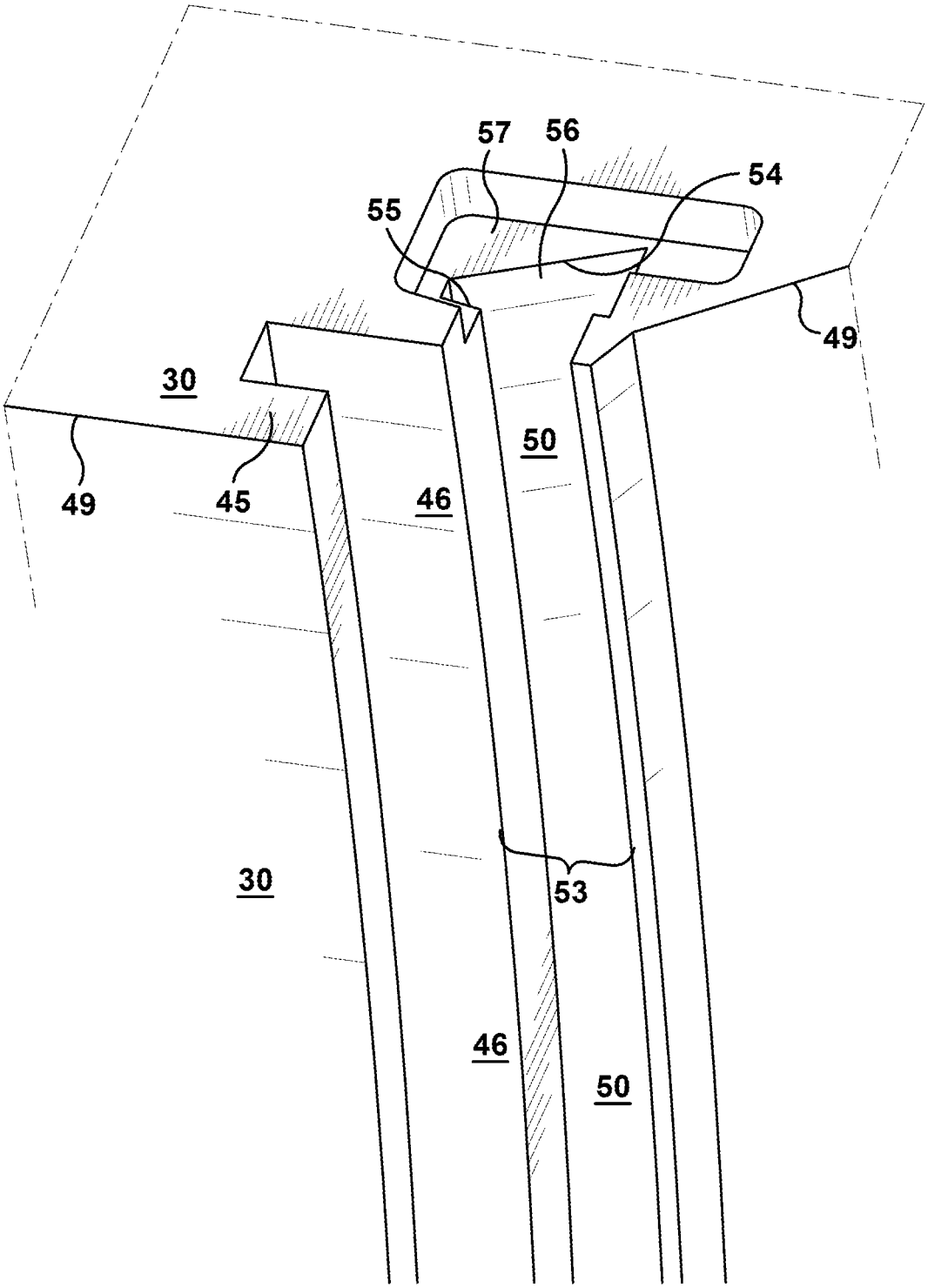
FIG. 6 is a perspective view of the casing of FIG. 5 after the bore holes have been removed by a machined a groove in accordance with the present disclosure.
Figure 7:
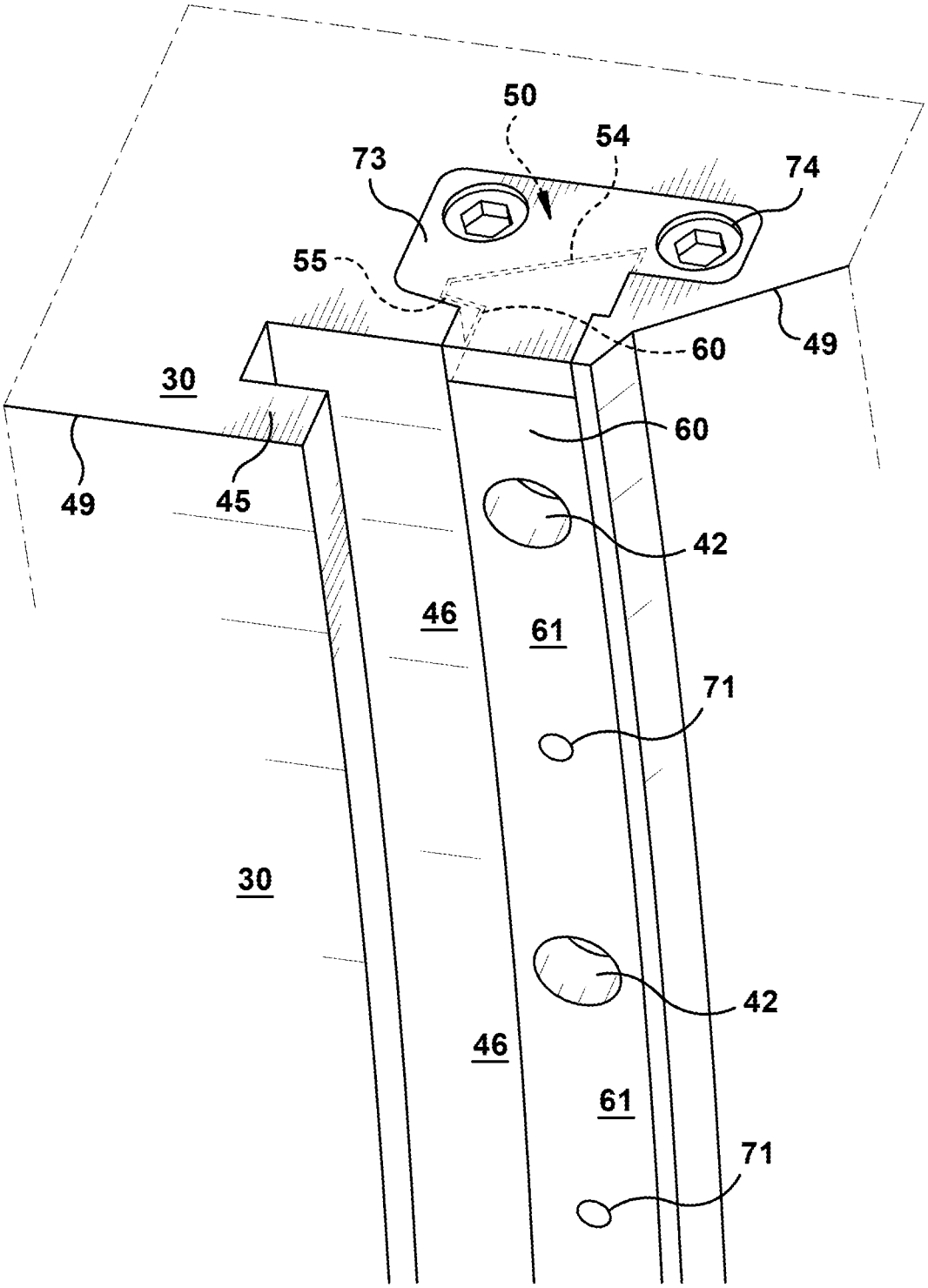
FIG. 7 is a perspective view of the casing of FIG. 5 once a segmented ring insert has been installed within the machined groove in accordance with the present disclosure.

With reference now to FIGS. 6 and 7, the present application discloses apparatus and/or methods for modifying an inner carrier or casing with a new bore hole pattern to facilitate changing blade count within a row of stator blades. For example, in accordance with an exemplary embodiment, the existing bore holes are removed by machining a circumferentially extending groove into the casing. As will be seen, once that is done, a patch segment or, as used herein, a "segmented ring insert"—which is configured with the new bore hole pattern—is inserted into the groove and secured to the casing.

FIG. 6 is a perspective view of the casing 30 of FIG. 5 after the existing bore hole pattern has been removed via the formation of a groove 50 on the inboard face 46 of the casing 30. The groove 50 may be positioned and configured so that the formation of it removes portions of the casing 30 that define the existing bore holes 42. More specifically, lengthwise, the groove 50 may extend circumferentially about the inboard face 46. Widthwise, the groove 50 may extend axially so that the width of the groove 50 coincides with the location of the bore holes 42 of the existing bore hole pattern. And, depthwise, the groove 50 may extend in an outboard direction from a mouth 53 formed planar to the inboard face 46. As will be appreciated, a backwall 54 of the groove 50 may oppose the mouth 53 and define the depth of the groove 50. The width and depth of the groove 50 may be configured in relation to the existing bore hole pattern (i.e., the location, size and depth of the bore holes 42 included within the pattern) so that the formation of the groove 50 sufficiently removes existing bore holes 42, either completely or partially, so that any interference between the existing bore hole pattern and the modified bore hole pattern is eliminated.

As depicted, the cross-sectional shape of the groove 50 may be one that widens, at least initially, as the groove 50 extends from the mouth 53 toward the back wall 54. This initial widening, for example, may include a lip portion 55 at which the width of the groove 50 is wider than width of the groove at the mouth 53. As also shown, the groove 50 may have an end opening 56 at a longitudinal end of the groove 50 that occurs at the split-line 49 of the casing 30. A recessed portion 57 may be formed about the end opening 56 of the groove 50, the use of which will be discussed more below. The groove 50 may be formed in the casing 30 using any conventional manufacturing processes. For example, the groove 50 may be machined therein using any conventional machining process, including traditional mechanical processes as well as other methods, such as laser or water cutting, electrical discharge machining, and electro-chemical erosion. As will be discussed more below, the groove 50 also may be cast into the casing 30 during the manufacture of the casing 30.

FIG. 7 is a perspective view of the casing of FIG. 5 once a segmented ring insert 60 has been installed within the groove 50 in accordance with the present disclosure. As indicated, the segmented ring insert 60 may have a cross-sectional shape that corresponds to the cross-sectional shape of the groove 50. As will be appreciated, the segmented ring insert 60 may be installed within the groove 50 via insertion through one of the end openings 56. Once installed, an outer face 61 of the segmented ring insert 60 may reside flush relative to the surrounding surface of the inboard face 46 of the casing 30. Formed through the outer face 61 of the segmented ring insert 60, bore holes 42 may be arranged in accordance with the bore hole pattern required by the new stator blade count. Though other configurations are also possible, the segmented ring insert 60 may have a length such that between 4 and 12 are needed to encircle the casing 30.

Once it is installed within the groove 50, the segmented ring insert 60 may be constrained or secured therewithin via one or more of the following ways. First, the segmented ring insert 60 may be configured to fit snugly within the groove 50 such that the cross-sectional shape of the groove 50 functions to restrains relative radial movement therebetween. For example, radial movement of the segmented ring insert 60 in the outboard direction may be restrained by abutting contact between the segmented ring insert 60 and the backwall 55 of the groove 50. Radial movement of the segmented ring insert 60 in the inboard direction may be restrained by abutting contact between the segmented ring insert 60 and the lip portion 55 of the groove 50, i.e., the widening of the cross-sectional shape of the groove 50 from the mouth 53 of the groove 50.

Second, the segmented ring insert 60 may be pinned or bolted to the backwall 54 of the groove 50 by pins 71. In this case, the pins 71 may extend through the segmented ring insert 60 and into the backwall 55 of the groove 50. As will be appreciated, the pins 71 may circumferentially secure the segmented ring segment 60 at a desired circumferential location.

Third, a cover plate 73 may be installed within the recessed portion 57 of the end opening 56. Specifically, a cover plate 73 may be provided that corresponds in shape to the recessed portion 57. Then, the segmented ring insert 60 may be circumferentially secured by closing the end opening 56 with the cover plate 73 once the segmented ring insert 60 has been fully inserted and positioned within the groove 50. For example, the cover plate 73 may be secured to the casing 30 by mechanical fasteners, such as, for example, one or more bolts 74. As shown, the cover plate 73 may be configured so that it resides flush to the surrounding surface of the casing 30.

The disclosure of the present application provides several advantages over the conventional approach of modifying stator blade count. These advantages, for example, include saving time and manpower by simplifying the adaptions needed for installing a row of stator blades having a changed bore hole pattern. Such time savings would improve overall engine availability and, generally, result in the less operational interruptions. Further, once the groove is installed, it will be appreciated that later modifications to the stator blade count may be achieved by simply inserting a modified segmented ring insert into the established groove. Aspects of the present disclosure may offer benefits during the design and manufacture of new turbine engines also. For example, the groove may be formed within the casing for use in installing the initial set of stator blades via a segmented ring insert. Such upfront usage of the groove/segmented ring insert assembly may provide greater flexibility in the design schedule because the selection of the bore hole pattern could occur at a later point in the development process. Further, upfront installation of the groove allows for convenient reconditioning and blade count modification throughout the operational life of the engine.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

That which is claimed:

1. A method of modifying a casing of a turbine engine for attaching stator blades of a row of stator blades to the casing, the method comprising the steps of:

forming a circumferentially extending groove in an inboard face of the casing, the groove having a cross-sectional shape and being formed to coincide axially with a set of existing bore holes formed within the inboard face of the casing;

providing a segmented ring insert that comprises bore holes spaced in accordance with a bore hole pattern that corresponds to a number of the stator blades of the row of stator blades;

inserting the segmented ring insert into the groove; and securing the segmented ring insert to the casing.

2. The method according to claim 1, wherein the existing bore holes comprise a bore hole pattern that is different than the bore hole pattern of the segmented ring insert.

3. The method according to claim 1, wherein the groove is formed having a mouth formed planar to the inboard face and a backwall that opposes the mouth and defines a depth of the groove.

4. The method according to claim 3, wherein the cross-sectional shape of the groove widens from the mouth to form a lip portion.

5. The method according to claim 4, wherein the segmented ring insert is provided having a cross-sectional shape that corresponds to the cross-sectional shape of the groove such that, once inserted within the groove, the segmented ring insert is radially constrained by the lip portion of the groove.

6. The method according to claim 1, wherein the groove is formed to comprise an end opening at a split-line of the casing.

7. The method according to claim 6, wherein the step of inserting the segmented ring insert into the groove comprises slidably engaging the segmented ring insert into the groove via the end opening.

8. The method according to claim 6, wherein the groove is formed having a recessed portion formed about the end opening.

9. The method of claim 8, further comprising the step of providing a cover plate that corresponds in shape with the recessed portion formed about the end opening.

10. The method of claim 9, where the step of securing the segmented ring insert to the casing comprises placing the cover plate within the recessed portion and then closing the end opening of the groove by securing the cover plate to the casing.

11. The method according to claim 1, wherein the segmented ring insert is provided having a cross-sectional shape that corresponds to the cross-sectional shape of the groove such that, once inserted within the groove, an outer face of the segmented ring insert resides flush relative to a surface of the inboard face of the casing that surrounds the groove.

12. The method according to claim 1, wherein, relative to a central axis of the turbine, the groove is formed such that:

a length of the groove is aligned in a circumferential direction;

a width of the groove is aligned in an axial direction; and a depth of the groove is aligned in a radial direction, the groove extending in an outboard direction from a mouth formed coplanar to the inboard face of the casing.

13. The method according to claim 12, wherein the groove comprises a lip portion at which a width of the groove is wider than a width of the groove at the mouth.

14. The method according to claim 13, wherein the segmented ring insert is provided having a cross-sectional shape that corresponds to the cross-sectional shape of the groove such that the segmented ring insert fits within the groove to form contact surfaces restraining radial movement of the segmented ring insert, including:

contact surfaces formed between the segmented ring insert and a backwall of the groove that restrain radial movement of the segmented ring insert in the outboard direction; and contact surfaces formed between the segmented ring insert and the lip portion of the groove that restrain radial movement of the segmented ring insert in the inboard direction.

15. A method of replacing an existing row of stator blades within a turbine engine with a replacement row of stator blades, wherein stator blades within the existing row of stator blades are circumferentially secured within a respective set of existing bore holes formed in an inboard face of a casing of the turbine engine, the method comprising the steps of:

detaching the existing row of stator blades from the respective set of existing bore holes formed in the inboard face of the casing;

forming a circumferentially extending groove in the inboard face of the casing, wherein the groove coincides axially with the respective set of existing bore holes and is configured so that the formation of the groove removes portions of the casing that define the respective set of existing bore holes, the groove defining a cross-sectional shape;

providing a segmented ring insert that corresponds in shape to the cross-sectional shape of the groove and that comprises bore holes spaced in accordance with a bore hole pattern that corresponds to a number of stator blades of the replacement row of stator blades;

inserting the segmented ring insert into the groove and securing the segmented ring insert to the casing; and circumferentially securing the stator blades of the replacement row of stator blades to the casing by inserting respective locking pins into respective bore holes of the bore holes formed in the segmented ring insert.

16. The method according to claim 15, wherein the number of stator blades of the replacement row of stator blades is different than a number of the stator blades of the existing row of stator blades;

and wherein:

the respective set of existing bore holes formed in the inboard face of the casing comprise a bore hole pattern that corresponds to the number of the stator blades of the existing row of stator blades.

17. The method according to claim 16, wherein the groove is formed having a mouth formed planar to the inboard face and a backwall that opposes the mouth and defines a depth of the groove; and wherein the cross-sectional shape of the groove widens from the mouth to form a lip portion.

18. The method according to claim 17, wherein the segmented ring insert is provided having the cross-sectional shape that corresponds to the cross-sectional shape of the groove such that, once inserted within the groove, the segmented ring insert is radially constrained by the lip portion of the groove.

19. The method according to claim 17, wherein the groove is formed so to comprise an end opening at a split-line of the casing; and wherein the step of inserting the segmented ring insert into the groove comprises circumferentially sliding the segmented ring insert into the groove via the end opening.

* * * * *